US011344792B1

(12) United States Patent
Marshall

(10) Patent No.: US 11,344,792 B1
(45) Date of Patent: May 31, 2022

(54) YARD GAME BOARD AND METHOD OF USING

(71) Applicant: Taylor Grant Marshall, Frankfort, KY (US)

(72) Inventor: Taylor Grant Marshall, Frankfort, KY (US)

( * ) Notice: Subject to any disclaimer, the term of this patent is extended or adjusted under 35 U.S.C. 154(b) by 0 days.

(21) Appl. No.: 17/001,273

(22) Filed: Aug. 24, 2020

Related U.S. Application Data

(60) Provisional application No. 62/891,717, filed on Aug. 26, 2019.

(51) Int. Cl.
*A63F 9/02* (2006.01)
*A63B 67/06* (2006.01)

(52) U.S. Cl.
CPC ..... *A63F 9/0204* (2013.01); *A63B 67/06* (2013.01); *A63B 2210/50* (2013.01)

(58) Field of Classification Search
CPC ..... A63F 9/0204; A63B 67/06; A63B 63/00
See application file for complete search history.

(56) References Cited

U.S. PATENT DOCUMENTS 2,021,989 A * 11/1935 De Master ..... A63F 9/0204 273/401
2,626,152 A * 1/1953 Miller ..... A63B 63/00 473/185
5,320,360 A * 6/1994 St. Pierre ..... A63F 9/0204 273/402
5,954,590 A * 9/1999 Nixey ..... A63B 67/02 473/185
10,675,529 B1 * 6/2020 Lumia ..... A63B 63/08
2008/0111312 A1 * 5/2008 Longo ..... A63B 67/06 273/402
2015/0108719 A1 4/2015 Devine
2015/0182852 A1 * 7/2015 Morgan ..... A63B 67/06 273/348.3
2016/0038809 A1 2/2016 Rockwell
2021/0060397 A1 * 3/2021 Lodge ..... A63B 67/06

OTHER PUBLICATIONS

"Skip nn' Hole Skipping Stonnes + Cornhole = Fun" Kickstarter, 2020. Retrieved from https://www.kickstarter.com/projects/1307976723/skip-nn-hole-skipping-stonnes-cornhole-fun. (26 Pages) [Acessed Aug. 24, 2020].

* cited by examiner

*Primary Examiner* — Michael D Dennis
(74) *Attorney, Agent, or Firm* — Middleton Reutlinger

(57) ABSTRACT

A board for a yard game, where the board a face portion and multiple openings through the face portion, where the openings may receive a projectile thrown by a player. The board additionally including at least one deflection zone for deflecting the projectile thrown by the player once contact is made between the projectile and the deflection zone. Each deflection zone including: a first edge portion; a second edge portion; and a deflection zone face portion located between the first edge portion and the second edge portion, where the deflection zone face is angled at about 30 degrees to about 90 degrees.

18 Claims, 8 Drawing Sheets

YARD GAME BOARD AND METHOD OF USING

BACKGROUND

Yard games are widely played at family gatherings, company picnics, tailgating at sporting events, and the like. Numerous such games exist, and conventionally may include boards, bags, and objects with the goal of scoring points. These games are typically played two-on-two. In such games, points are typically awarded by landing a bag or ball either onto the board or into an opening passing through the board.

An example of such a game may include cornhole, which may also be known as beanbag toss, bags, tailgate toss, baggo, sack toss, and bean sack. In cornhole, there may be two slanted boards with a hole through the top surface that are placed a predetermined distance apart from each other. In cornhole, players stand at the side of one cornhole board and toss cornhole bags at the other cornhole board, attempting land a cornhole bag on the cornhole board or into the hole to gain points.

Yard games have become increasingly more popular, and accordingly there is a continuing need for new challenging and engaging yard games for entertainment at social functions.

SUMMARY

The herein-described embodiments address these and other problems associated with the art by providing a board for a yard game, the board including: a face portion; a plurality of openings through the face portion, where each of the plurality of openings may be capable of having a projectile thrown through them by a user; at least one deflection zone configured to deflect the projectile thrown by the user when contact is made between the projectile and the at least one deflection zone, where the at least one deflection zone includes: a first edge portion; a second edge portion; a deflection zone face portion located between the first and second edge portions, where the deflection zone face is angled at about 30 degrees to about 90 degrees.

In some embodiments, the at least one deflection zone is a first deflection zone, and the board for the yard game also includes a second deflection zone. In some such embodiments, the first and the second deflection zones form a first side and a second side, respectively, of a substantially triangular-shaped opening, and where an upper edge of the face portion forms a third side of the substantially triangular-shaped opening. In some such embodiments, each of the first and the second deflection zones have a first end and a second end, and where each of the first and the second deflection zones are removably attached to the face portion at the first end. In some embodiments, the second end of the first deflection zone and the second end of the second deflection zones are in contact forming an apex of the substantially triangular-shaped opening. In some instances, the board may additionally include at least one prop stick, where the prop stick(s) includes a first end configured to contact a ground surface and a second end configured to contact the board. In other instances, the face portion is a third deflection zone.

In some embodiments, the face portion further includes a first side and a second side. In some such embodiments, the first and second sides are connected together and configured to collapse for storage.

In some embodiments, the board additionally includes an upper stabilizer coupled to an upper portion of the face portion and a lower stabilizer coupled to a lower portion of the face portion. In some such embodiments, the upper stabilizer and lower stabilizer further include a dovetail joint that is configured to allow the upper and lower stabilizers to collapse for storage.

In some embodiments, the at least one of the plurality of openings through the face portion is a substantially circular opening. In some such embodiments, the substantial circular opening is about 4 inches in diameter to about 20 inches in diameter. In some embodiments, the face portion is constructed of corrugated plastic.

In another aspect a collapsible board for a yard game is disclosed herein, the board comprising: a first face portion and a second face portion collapsibly coupled; a plurality of openings through the face portion, where each of the plurality of openings are configured to receive a projectile thrown by a user; a first deflection zone and a second deflection zone, each of which is configured to deflect the projectile thrown by the user when contact is made between the projectile and the first or second deflection zones, where each of the first and second deflection zones include: a first and second edge portion; a first and second end; a deflection zone face portion disposed between the first edge portion and the second edge portion, where the deflection zone face is angled at about 30 degrees to about 90 degrees; where the first and second deflection zones are removably attached to the face portion at the first end; and where the first and the second deflection zones form a first side and a second side, respectively, of a substantially triangular-shaped opening, where an upper edge of the face portion forms a third side of the substantially triangular-shaped opening.

In some embodiments, the second end of the first deflection zone and the second end of the second deflection zones are in contact forming an apex of the substantially triangular-shaped opening. In other embodiments, the face portion is a third deflection zone. In still other embodiments, the first and second sides are connected together and configured to collapse for storage.

In some embodiments, the board additionally includes an upper stabilizer coupled to an upper portion of the face portion and a lower stabilizer coupled to a lower portion of the face portion, where the each of the upper and lower stabilizer include a dovetail joint that is configured to allow the upper and lower stabilizers to collapse for storage.

In some embodiments, the at least one of the plurality of openings through the face portion is a substantially circular opening, where the diameter of the substantial circular opening is about 4 inches in diameter to about 20 inches in diameter. In other embodiments, the face portion and first and second deflection zones are constructed of a corrugated plastic.

These and other advantages and features, which characterize the embodiments, are set forth in the claims annexed hereto and form a further part hereof. However, for a better understanding of the embodiments, and of the advantages and objectives attained through its use, reference should be made to the Drawings and to the accompanying descriptive matter, in which there is described example embodiments. This summary is merely provided to introduce a selection of concepts that are further described below in the detailed description, and is not intended to identify key or essential features of the claimed subject matter, nor is it intended to be used in limiting the scope of the claimed subject matter.

DETAILED DESCRIPTION

Figure 1:
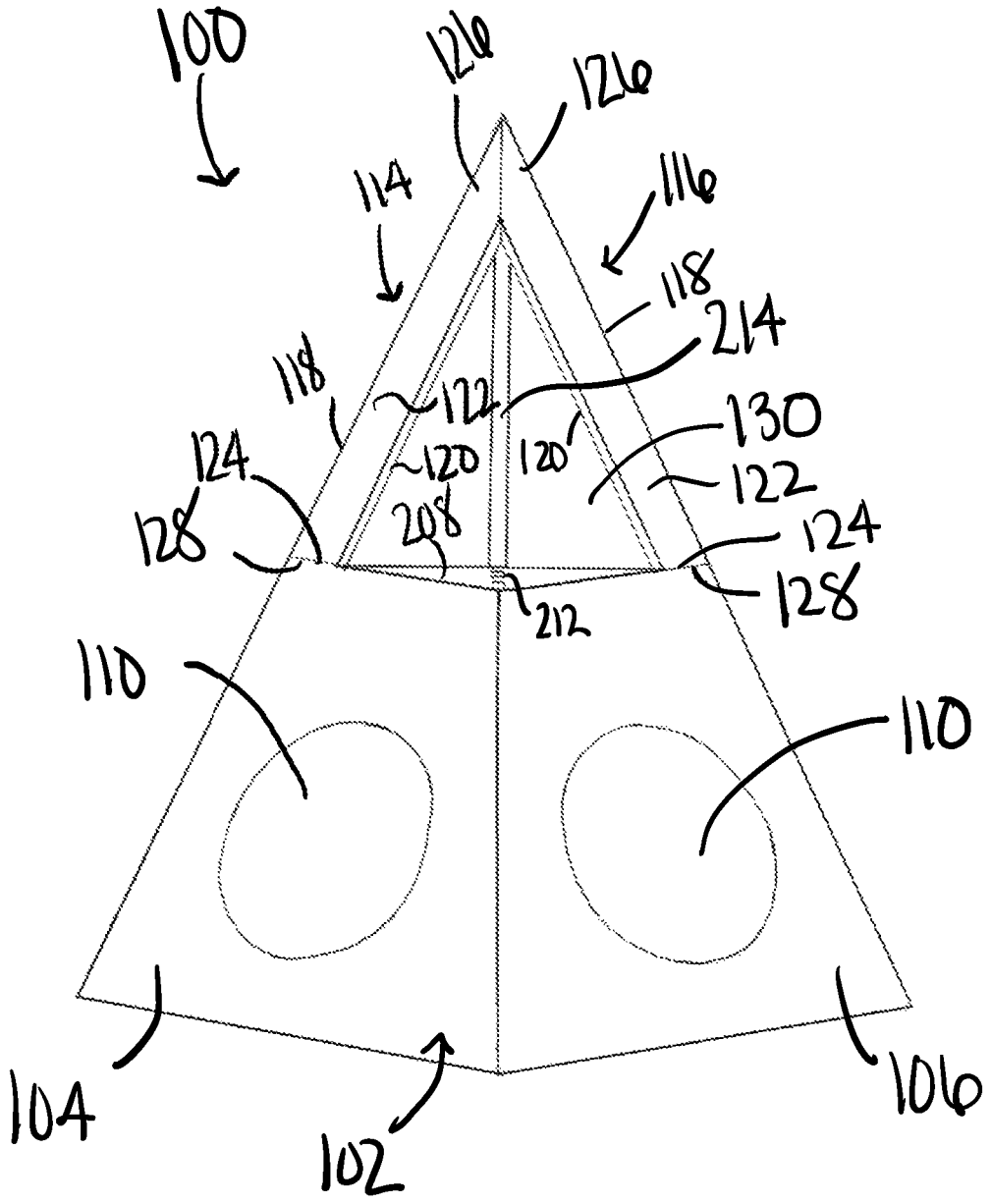
FIG. 1 is a front perspective view of a board for a yard game consistent with some embodiments described herein.

Turning now to the drawings, wherein like numbers denote like parts throughout the several views, FIG. 1 illustrates a board 100 for use in a yard game. In play, two boards may be set a pre-defined distance apart (see FIG. 5) with a player or team of players assigned to each. Generally, the goal of the game, which will be described in detail herein, is to throw a projectile (e.g. a disc, ball, or the like) at the board and through the openings of the board. The board 100 may be generally pyramid-shaped, as is illustrated throughout FIGS. 1-4. However, the board may also be other shapes, including, but not limited to, a half-circle shape, a square shape, etc.

The board 100 includes a face portion 102, which may encompass the lower region of the board 100. The In some instances, such as illustrated in FIG. 1, the face portion 102 includes a first side 104 and a second side 106. The first and second sides 104, 106 of the face portion 102 may be buttressed, coupled or otherwise joined together, although this is not to be understood as limiting. For example, in some instances, this coupling or joining may be through the use of a glue, staple, or hinge, which allow the first side 104 and the second side 106 to be able to fold, bend, or collapse for storage of the board 100 (see FIG. 4). Other examples of coupling mechanisms that may be used for the first and second sides 104, 106 of the face portion 102 include, but are not limited to hook and bop, button snaps, grommets, or the like. As illustrated herein, the first and second sides 104, 106 of the face portion may each be positioned at an angle, so that when buttressed or coupled, portions of each side 104, 106 may extend outward from the remainder of the face portion 102.

The face portion 102 may also include a plurality openings 110 extending through the face portion 102. These openings are configured to receive the projectile (ball, disc, etc.) thrown by the players. In FIG. 1, these openings 110 are circular, but this is not intended to be limiting. In other instances, the openings 110 may be ovular, triangular, diamond-shaped, square, any other shape known or desired, or a combination thereof. The size of these openings 110 may also vary, which may also vary the difficulty of the game. For example, a board 100 with larger sized openings may be used for beginner or lower-skilled players; while a board 100 with smaller sized openings may be used for players that are more skilled. In some instances, such as when the openings 110 are circular, may vary from about 4 inches to about 20 inches in diameter.

The face portion 102 may, in some instances, be constructed of plastic, in particular corrugated plastic. In other instances, the face portion 102 may be constructed of dimensional lumber, metal, pvc, plywood, or any other suitable material. It is preferable, although not required, that the material constructing the face portion 102 (and remainder of the board 100) be lightweight so that the board 100 may be easily collapsed, stored, and transported. In other instances, the entirety of the board 100 described herein may be produced through an injection molding process (for example, using plastic), which may be desirable for large-scale production of boards 100. In some such instances, the board 100 may be constructed using injection molding and may be capable of folding up for storage. In other such instances, the board 100 may be produced, via injection molding, as separate pieces that are connected together (e.g. through glue, staples, etc.).

Figure 3:
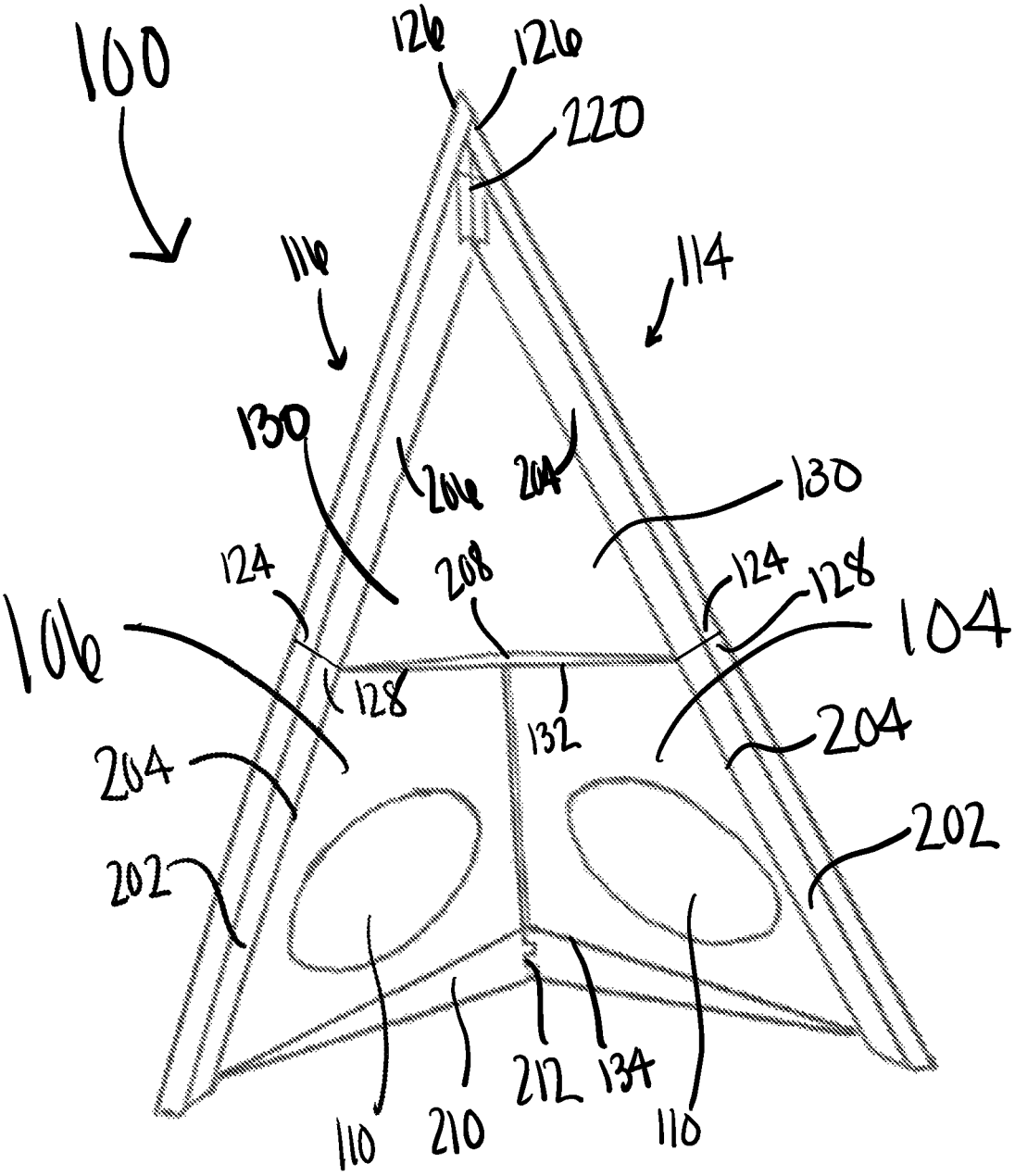
FIG. 3 is a rear perspective view of the board for a yard game of FIG. 1 consistent with some embodiments described herein. The prop stick has been removed from this view in order to more clearly visualize the rear of the board.

In some instances, the face portion 102 may be coupled with one or more support structures (not visible in FIG. 1, see 202 in FIG. 3). The support structures 202 may support and stabilize the board 100, especially when placed on an uneven surface, such as a yard. As illustrated in FIG. 3, the support structures 202 may be positioned on an outermost edge of each of the first and second sides 104, 106 of the face portion 102. In some instances, the support structures may be a wooden 1 inch by 4 inch board, although this is not to be understood as limiting. In other instances, the support structures 202 may be metal rods, constructed from corrugated plastic, constructed of injected molded plastic, or the like.

Returning now to FIG. 1, the board 100 may further include at least one deflection zone 114, 116. As will be described in detail herein, points from throwing a projectile (e.g. ball, disc, etc.) through one of the openings 110 of the face portion 102 may be negated by an opposing player catching a projectile after it contacts and is deflected off a surface of the board 100. In particular, a first deflection zone 114 and a second deflection zone 116 may be disposed on top of the face portion 102. The first and the second deflection zone 114, 116 may each include a first edge portion 118, a second edge portion 120, and a deflection zone face portion 122 that is positioned between the first and second edge portions 118, 120. The slope of the deflection zone between the first edge portion 118 and the second edge 120 portion is about 30 degrees to about 90 degrees.

In some instances, the first and second deflection zones 114, 116 may also each have a first end 124 and a second end 126. The first end 124 of each of the first and second deflection zones 114, 116 may couple with an upper edge 128 of the face portion 102. In some instances, the first end 124 of the first deflection zone 114 may be coupled with the upper edge 128 of the first side 104 of the face portion, while the first end 124 of the second deflection zone 120 may be coupled with the upper edge of the second side 106 of the face portion 102. In such instances, the first and second deflection zones 114, 116 may form a first and second side of a substantially triangular-shaped opening 130. In such instances, an upper edge 128 of the face portion 102 may form the third side, or the base, of the substantially triangular-shaped opening 130. The angles of the substantially triangular-shaped opening may vary by the positioning of the first and second deflection zones 114, 116; however, in an example, the substantially triangular-shaped opening 130 may generally be an approximately equilateral or about a 60-60-60. The second end 126 of the first deflection zone 114 and the second end 126 of the second deflection zone 120 may be in contact with each other, forming the apex of the substantially triangular-shaped opening 130. As will be described herein, points may also be awarded to a player or team for throwing the projectile (e.g. ball, disc, etc.) through this substantially triangular-shaped opening 130. Where the second end 126 of the first deflection zone 114 and the second end 126 of the second deflection zone 120 contact each other, forming the apex of the substantially triangular-shaped opening, they may, in some instances, be attached through a hinge or the like. In other instances, they may just be in physical contact without a formal attachment mechanism.

Similar to the face portion 102, the first and second deflection zones 114, 116 may be constructed plastic, for example corrugated plastic, dimensional lumber, metal, pvc, plywood, or any other suitable material. Where constructed of corrugated plastic, or any other lighter, more flexible material, the first and second deflection zones 114, 116 may further comprise a first and second deflection zone posts (not visible in FIG. 1, see 204, 206 in FIG. 3). These posts 204, 206 may further support and stabilize the board 100, for example so that a slight gust of wind does not topple the board 100.

Figure 4:
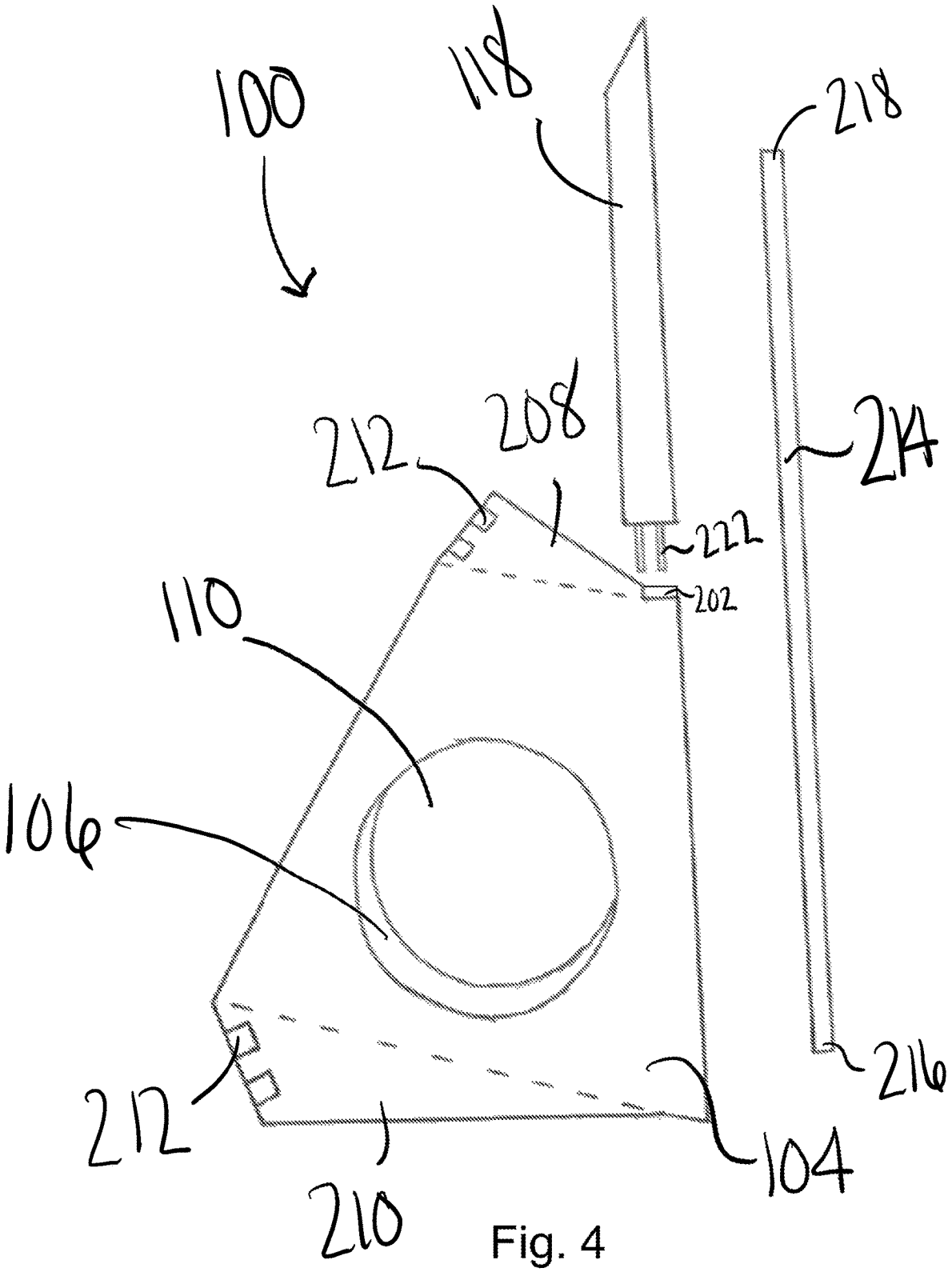
FIG. 4 is a collapsed view of the board for a yard game of FIG. 1 consistent with some embodiments described herein.

In some instances, the first and second deflection zones 114, 116 may be removably coupled to the upper edge 128 of the first side 104 of the face portion. The ability to remove the first and second deflection zones 114, 116 may enhance the ability to store and transport the board 100. This removable coupling may be achieved through any mechanism known in the art, including but not limiting to a male/female fitting formed into the pieces. As illustrated in FIG. 4, which is a collapsed view of the board 100, the first and second deflection zones 114, 116 are removably coupled with the face portion 102 through a use of a plurality of dowels 222 on the first and second deflection zones 114, 116 and receiving holes (not visible) on the support structures 202 of the face portion 102.

In some instances, the entire board 100, including the face portion 102 may be deflection zones. In such instances, a projectile (e.g. ball, disc, etc.) may contact any surface of the board 100, for example the front portion 102, and it may be deflected (e.g. bounce) off of the board 100 rather than passing through one of the openings 110, 130.

Figure 2:
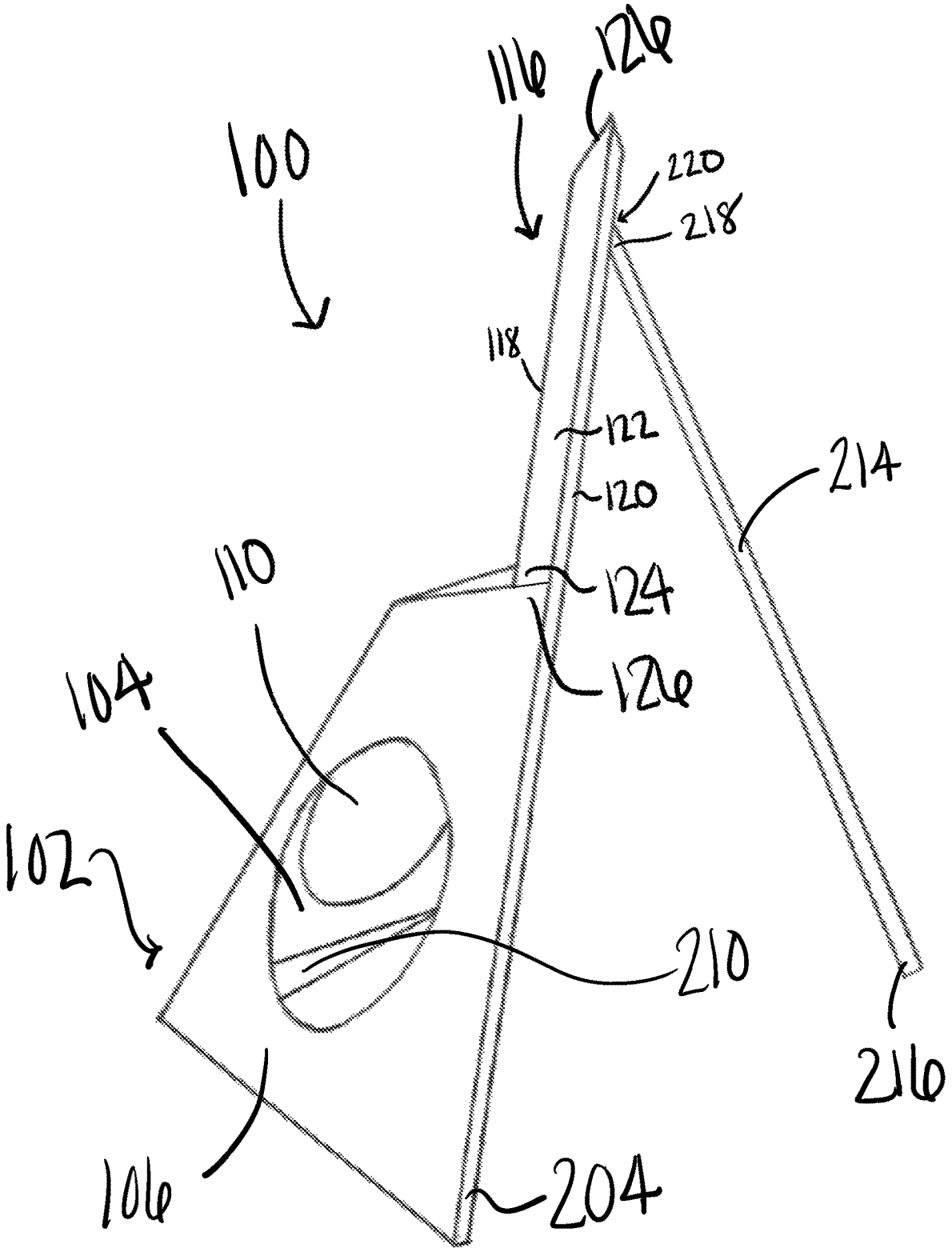
FIG. 2 is a side view of the board for a yard game of FIG. 1 consistent with some embodiments described herein.

Referring now to FIGS. 2 and 3, a rear and side view, respectively, of the board 100 are illustrated. As previously mentioned, the face portion 102 may be coupled with one or more support structures 202, which may support and stabilize the board 100. Similarly, the first and second deflection zones 114, 116 may also include first and second deflection zone posts 204, 206, which also stabilize the board 100. The board 100 may, in some instances, include additional stabilizing structures. For example, the board 100 may include an upper stabilizer 208 and lower stabilizer 210. These stabilizers 208, 210, where present, may each couple to the face portion 102 of the board 100. For example, the upper stabilizer 208 may be coupled to an upper interior edge 132 of the face portion 102. In some instances, this coupling may be permanent, while in other instances, the upper stabilizer 208 may be removably coupled to the upper interior edge 132 of the face portion 102. Similarly, the lower stabilizer 208 may also be coupled to the face portion 102 at a lower interior edge 134. In some instances, both the upper and lower stabilizers 208, 210 may additionally include a dovetail joint 212. This dovetail joint 212 may allow the upper and lower stabilizers 208, 210 to collapse for storage (see FIG. 4). In some instances, the upper and lower stabilizers 208, 210 are constructed of the same material, for example corrugated plastic, as the face portion 102 and/or deflection zones 114, 116. However, this is not to be understood as limiting, as the upper and lower stabilizers 208, 210 may be constructed of any other suitable material (e.g. dimensional lumber, metal, pvc, plywood, or the like). Although illustrated and described herein as including both an upper and lower stabilizer 206, 208, this is not to be understood as limiting. In some instances, the board 100 may include only an upper stabilizer 208 or a lower stabilizer 210; in other instances, the board 100 may not include either an upper or lower stabilizer 208, 210.

In some instances, a prop stick 214 may further support the board 100. The prop stick 214 may include a first end 216 that sits on the ground and a second end 218 that contacts the crevasse 220 where the second end 126 of the first and second deflection zones 114, 116 meet at the apex of the substantially triangular-shaped opening 130. The prop stick 214 may, in some instances, be constructed of wood, but this is not intended to be limiting, as the prop stick 214 may also be constructed of metal, plastic, or any other suitable material. In some instances, the prop stick 214 may removably contact the board 100, and may be removed for the board 100 to be collapsed and stored.

Figure 7:
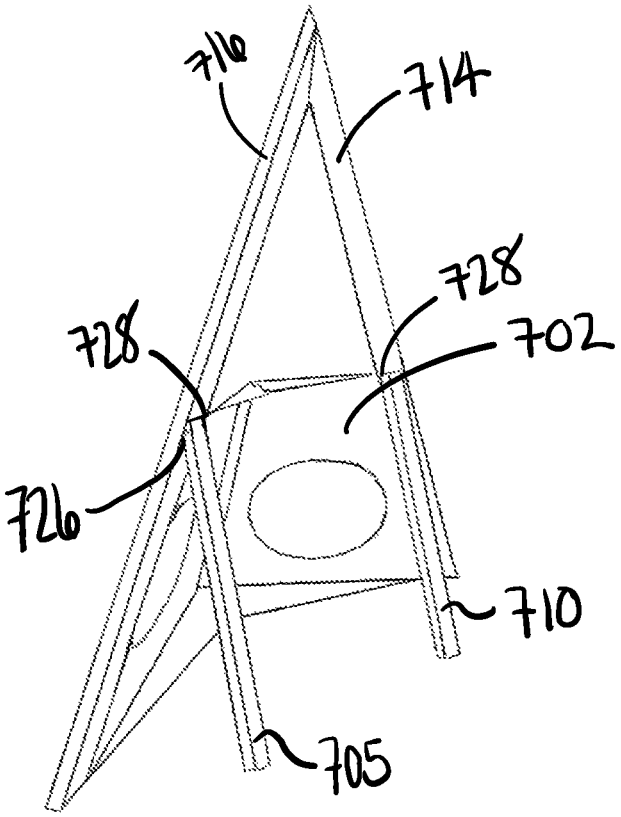
FIG. 7 is a side view of another embodiment of a board for a yard game consistent with some embodiments described herein.

In other instances, for example as illustrated in FIG. 7, the board 700 may include a first prop stick 705 and a second prop stick 710. In such instances, the first and second prop sticks 705, 710 may contact an upper edge 728 of the face portion 702. Specifically, the first and second prop sticks may contact the board 700 where the first end 724 of each of the first or second deflection zones 714, 716 may couple with the upper edge 728 of the face portion 702. In some instances, the prop stick(s) may be couple to the board through use of a hinge 726. This hinge 726 may allow the first and second prop sticks 705, 710 to towards the face portion 702 for storage.

Figure 8:
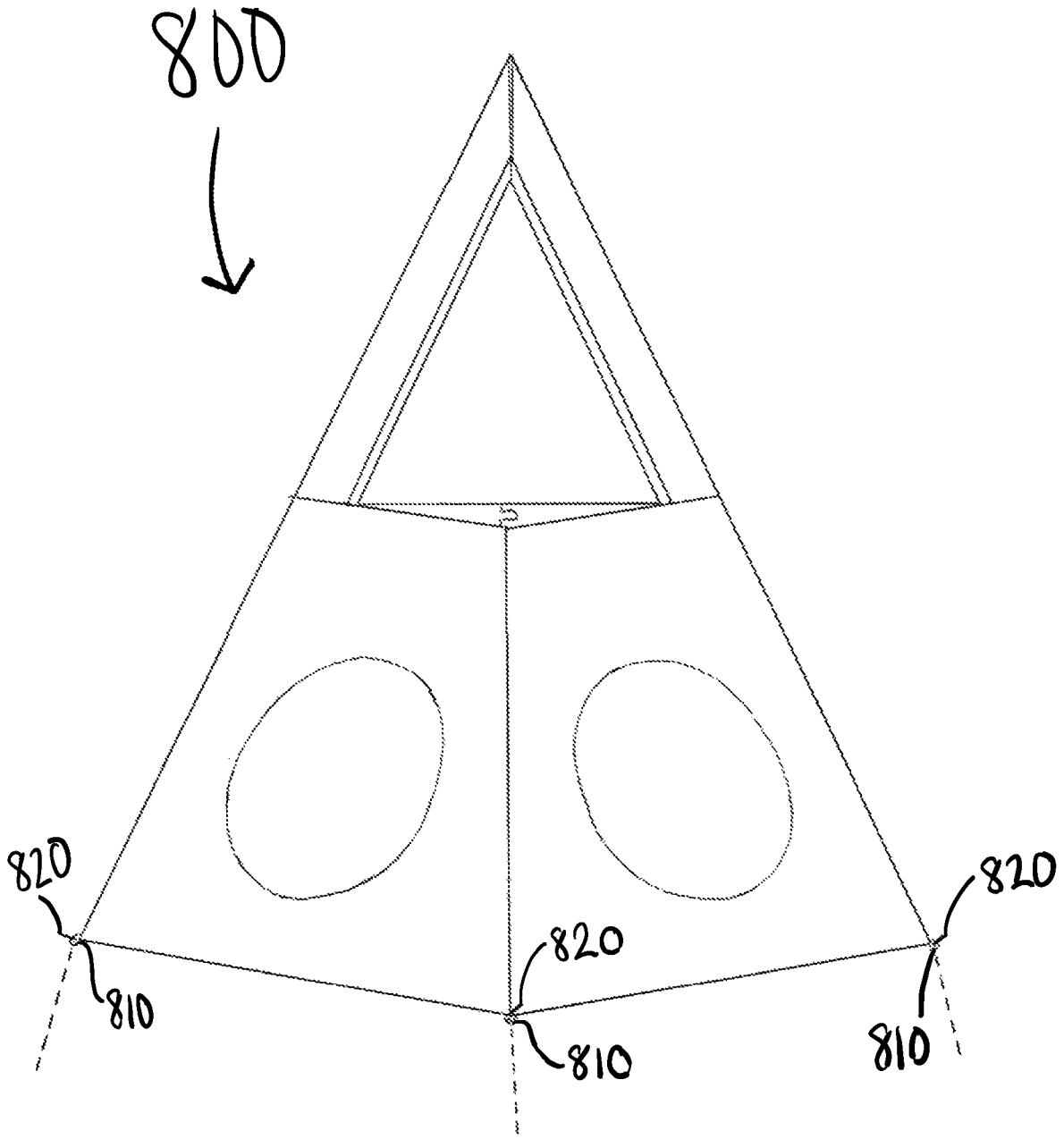
FIG. 8 is a front perspective view of another embodiment of board for a yard game consistent with some embodiments described herein.

In still other instances, for example as illustrated in FIG. 8, the board 800 may be staked, or otherwise fastened, to the ground. In such instances, the board 800 may further include loops 810 or receiving portions for a stake 820 (e.g. a traditional metal or plastic stake utilized for camping or other such equipment). For example, these loops or receiving portions may be located at a lower edge of the front portion of the board. The stakes may then be placed through the loops or receiving portions and into the ground.

Figure 5:
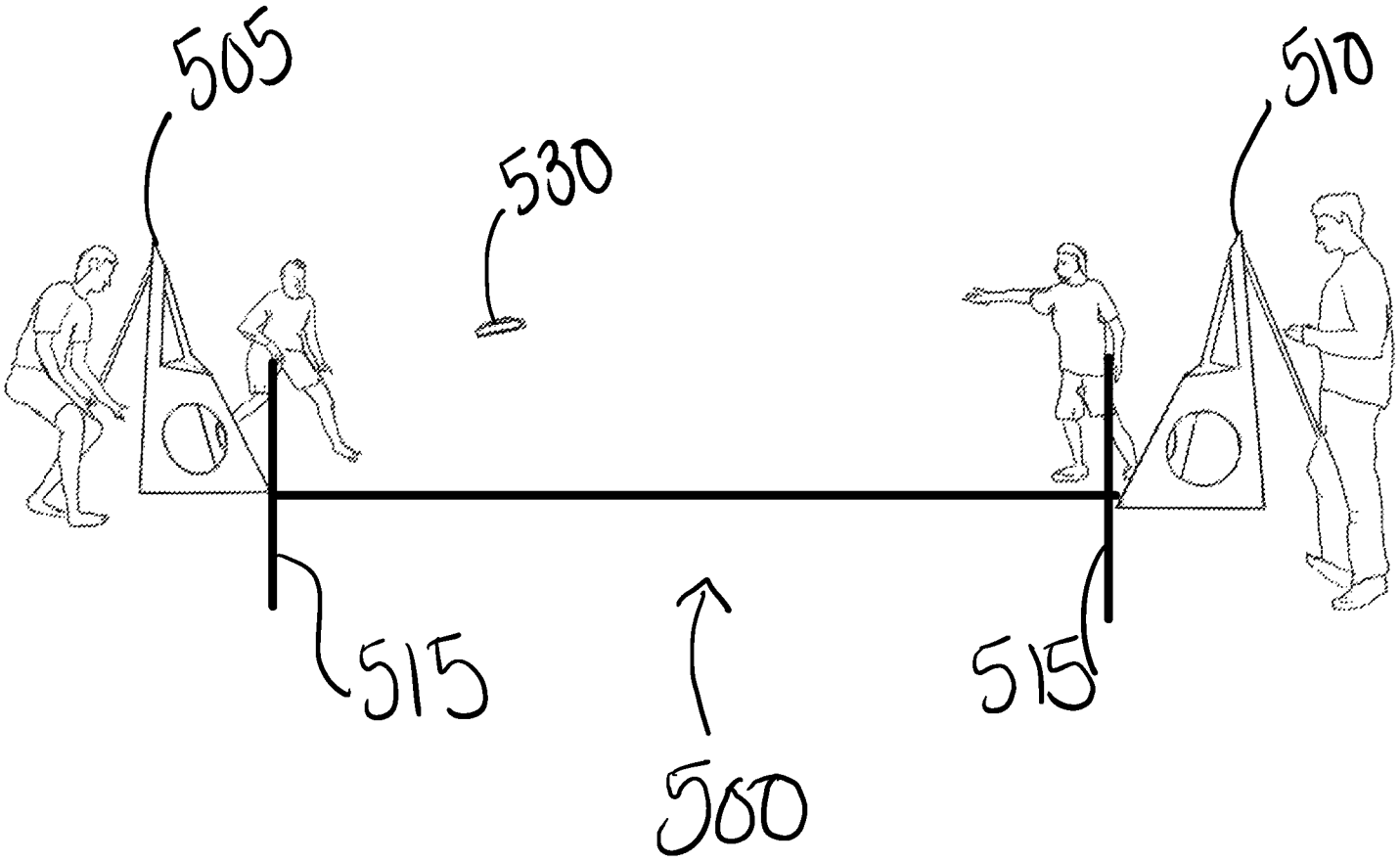
FIG. 5 is a schematic of a playing area for a yard game that utilizes the boards consistent with some embodiments described herein.

Turning now to FIG. 5, an exemplary schematic of a playing area 500 for playing a yard game with the board described with reference to FIGS. 1-4 is illustrated. A described herein, the board includes a plurality of openings, which may vary in shape and size. Points may be scored by an individual or a team by throwing a projectile 530, such as a ball or disc and striking the broad or passing the projectile through the openings through the board. As illustrated in FIG. 5, a first board 505 may be positioned directly opposing a second board 510 on the playing area 500. The distance between the first and second boards 505, 510 may vary depending on a variety of factors, including but not limited to, space constraints, skill level, and so on. In some instances, the space between the first and the second board 505, 510 may be about 20 feet to about 50 feet.

The game may be played by two teams. In some instances, the teams have two players each; however, this is not intended to be limiting, in some instances, the each team is only a single person, or a team could be three or more people. Regardless of the size of the team, the teammates stand to either side of their respective board. In some instances, the teammates may stand at or behind the line of play 515 or face portion of the board 505. The opposing team may stand at the opposite end of the playing area 500 next to their respective board 510.

In some instances, the game is played until a preset number of points have been reached by an individual or team. For example, the game may be played until twenty-one (21) points are reached; however this is not intended to be limiting, as the game may be played to any number of points agreed upon by the players. During play there may be various rounds, in which a player may throw three (or any other agreed upon number of) consecutive projectiles 530 (e.g. discs, balls, etc.) towards the opposing team's board. Points are scored when the projectile passes through either the substantially triangle-shaped opening or any of the other plurality of openings of the opposing team's board. For example, a team may receive three (3) points for the projectile passing through the substantially triangular-opening and two (2) points for the projectile passing through any of the other openings. In some instances, a team may also receive one (1) point for the projectile making contact anywhere on the board. If the projectile thrown is caught at any time by the opposing player or team the points for that round of play may be cleared. For example, if an opposing player catches the projectile after it bounces off a deflection zone, front portion, or anywhere else on the board the points for that round of play cleared. As an example, if a team's first two throws yielded points from the projectile either contacting the board or passing through an opening, but the third throw is caught by the opposing team, zero (0) points are earned for that round, as the points are cleared. Typically, player may be required to stand behind the line of play 515 until after the projectile makes contact with the board; however, after the projectile makes contact with and deflecting off of the front portion of the board, a player move in front of the line of play 515 to catch the projectile.

Optionally, the game may be played to exactly twenty-one (21) points (or the predetermined number of points). In such instances, if a team "busts" or scores over twenty-one points, that ream's score may be reset to 15 points. After that team's score is reset to 15 points, the game may then continue until exactly twenty-one points are reached by one of the reams.

Optionally, the game may be played where an opposing team may have an opportunity to rebut. In particular, this may be the case where the team that took the first turn (e.g. the team to throw the first projectile of the game) is the first team to make it to the predetermine number of winning points (i.e. 21). In such instances, the opposing team may have an opportunity to rebut, or tie the game. If the game is tied after the rebuttal, the teams may then play in a sudden death style match to six (6) points.

It is to be understood that the guidelines for play presented herein are merely exemplary. The various embodiments of the board described herein may be used with other variations to the rules.

Figure 6:
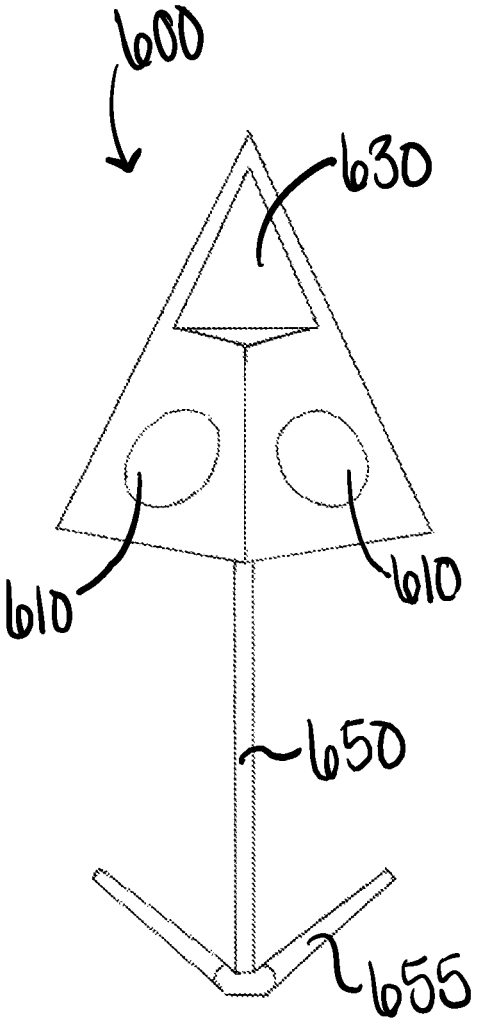
FIG. 6 is a front perspective view of a miniature board and stand for a yard game consistent with some embodiments described herein.

In some instances, the board described with reference to FIGS. 1-4 may be miniaturized as used with a smaller projectile, for example a "ZipDisc", a disc golf putting disc, ping-pang ball, etc. In such instances, for example as illustrated in FIG. 6, the miniature board 600 may have the same shape and features as the board described with reference to FIGS. 1-4, but is merely constructed on a smaller scale. The miniaturized board 600 may still have the same configuration of scoring holes and deflection zones. For example, the miniaturized board 600 may include two circular openings 610 and a substantially triangular-shaped opening 630. In some instances, it may be desirable, rather than using a prop stick, to mount the miniaturized board 600 to a pole 650 and stand 655, so that the board may be brought to a playable height, for example, between about three feet and six feet. In other instances, the miniaturized board 600 may be placed on a table to bring the boards to a desired height. The use of a table(s) for the miniature boards may be particular desirable where play is to be inside of a structure (e.g. a basement, garage, etc.). Additionally, the size of the playing area or the distance between the boards may be altered to accommodate for the smaller size of the boards. For example, when placed on a stand outside, the miniature boards may be placed about 20 feet to about 40 feet apart; when placed on a table for play inside, the miniature boards may be placed closer together.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or"

as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A board for a yard game, the board comprising:

a face portion;

a plurality of openings through the face portion, wherein each of the plurality of openings are configured to receive a projectile thrown by a user;

at least one deflection zone configured to deflect the projectile thrown by the user when contact is made between the projectile and the at least one deflection zone, wherein the at least one deflection zone comprises:

a first edge portion;

a second edge portion;

a deflection zone face portion disposed between the first edge portion and the second edge portion, wherein the deflection zone face portion is angled at about 30 degrees to about 90 degrees;

wherein the at least one deflection zone is a first deflection zone, and the board for the yard game further comprises a second deflection zone; and, wherein the first and the second deflection zones form a first side and a second side, respectively, of a substantially triangular-shaped opening, wherein an upper edge of the face portion forms a third side of the substantially triangular-shaped opening.

2. The board for yard game of claim 1, wherein each of the first and the second deflection zones have a first end and a second end, and wherein each of the first and the second deflection zones are removably attached to the face portion at the first end.

3. The board for yard game of claim 2, wherein the second end of the first deflection zone and the second end of the second deflection zone are in contact forming an apex of the substantially triangular-shaped opening.

4. The board for a yard game of claim 1 further comprising at least one prop stick, wherein the at least one prop stick includes a first end configured to contact a ground surface and a second end configured to contact the board.

5. The board for yard game of claim 1, wherein the face portion is a third deflection zone.

6. The board for yard game of claim 1, wherein the face portion further includes a first side and a second side.

7. The board for yard game of claim 6, wherein the first and second sides are connected together and configured to collapse for storage.

8. The board for yard game of claim 1 further comprises an upper stabilizer coupled to an upper portion of the face portion and a lower stabilizer coupled to a lower portion of the face portion.

9. The board for yard game of claim 8, wherein each of the upper stabilizer and lower stabilizer further include a dovetail joint that is configured to allow the upper and lower stabilizers to collapse for storage.

10. The board for yard game of claim 1, wherein at least one of the plurality of openings through the face portion is a substantially circular opening, wherein the substantially circular opening is about 4 inches in diameter to about 20 inches in diameter.

11. The board for yard game of claim 1, wherein the face portion is constructed of corrugated plastic.

12. A collapsible board for a yard game, the board comprising:

a first face portion and a second face portion collapsibly coupled;

a plurality of openings through the first and second face portions, wherein each of the plurality of openings are configured to receive a projectile thrown by a user;

a first deflection zone and a second deflection zone, each of which is configured to deflect the projectile thrown by the user when contact is made between the projectile and the first or second deflection zones, wherein each of the first and second deflection zones comprise:

a first and second edge portion;

a first and second end;

a deflection zone face portion disposed between the first edge portion and the second edge portion, wherein the deflection zone face portion is angled at about 30 degrees to about 90 degrees;

wherein the first deflection zone is removably attached to the first face portion at the first end of the first deflection zone and second deflection zone is removably attached to the second face portion at the first end of the second deflection zone; and wherein the first and the second deflection zones form a first side and a second side, respectively, of a substantially triangular-shaped opening, wherein an upper edge of the face portion forms a third side of the substantially triangular-shaped opening.

13. The board for yard game of claim 12, wherein the second end of the first deflection zone and the second end of the second deflection zones are in contact forming an apex of the substantially triangular-shaped opening.

14. The board for yard game of claim 12, wherein the first and second face portions are a third deflection zone.

15. The board for yard game of claim 14, wherein the first and second sides are connected together and configured to collapse for storage.

16. The board for yard game of claim 12 further comprises an upper stabilizer coupled to an upper portion of the first and second face portions and a lower stabilizer coupled to a lower portion of the first and second face portions, wherein the each of the upper and lower stabilizer include a dovetail joint that is configured to allow the upper and lower stabilizers to collapse for storage.

17. The board for yard game of claim 12, wherein at least one of the plurality of openings through the first or second face portions is a substantially circular opening, wherein the diameter of the substantially circular opening is about 4 inches in diameter to about 20 inches in diameter.

18. The board for yard game of claim 12, wherein the first and second face portions and first and second deflection zones are constructed of a corrugated plastic.

* * * * *